US010839771B2

(12) United States Patent
Radhakrishnan et al.

(10) Patent No.: US 10,839,771 B2
(45) Date of Patent: Nov. 17, 2020

(54) DISPLAY DRIVER

(71) Applicant: INTEL CORPORATION, Santa Clara, CA (US)

(72) Inventors: Prakash K. Radhakrishnan, Portland, OR (US); Khaled Ahmed, Anaheim, CA (US)

(73) Assignee: INTEL CORPORATION, Santa Clara, CA (US)

( * ) Notice: Subject to any disclaimer, the term of this patent is extended or adjusted under 35 U.S.C. 154(b) by 147 days.

(21) Appl. No.: 15/387,973

(22) Filed: Dec. 22, 2016

(65) Prior Publication Data

US 2018/0182354 A1 Jun. 28, 2018

(51) Int. Cl.

| | |
|---|---|
| ***G09G 5/10*** | (2006.01) |
| ***G09G 3/32*** | (2016.01) |
| ***G09G 3/3233*** | (2016.01) |
| ***G09G 3/20*** | (2006.01) |

(52) U.S. Cl.

CPC ..... *G09G 5/10* (2013.01); *G09G 3/2014* (2013.01); *G09G 3/2018* (2013.01); *G09G 3/32* (2013.01); *G09G 3/3233* (2013.01); *G09G 2300/0408* (2013.01); *G09G 2300/0426* (2013.01); *G09G 2310/0286* (2013.01); *G09G 2310/0289* (2013.01); *G09G 2310/06* (2013.01); *G09G 2310/08* (2013.01); *G09G 2320/0626* (2013.01)

(58) Field of Classification Search

CPC ..... G09G 5/10; G09G 3/32; G09G 3/2014; G09G 3/2018; G09G 3/3233; G09G 3/2037; G09G 3/2051; G09G 3/3275; H04N 1/02815; H04N 1/4057; H04N 3/155; H04N 5/357; B41J 2/451

USPC ..... 345/691

See application file for complete search history.

(56) References Cited

U.S. PATENT DOCUMENTS

| | | | | |
|---|---|---|---|---|
| 4,809,082 | A * | 2/1989 | Yamaguchi | H04N 1/4057 358/3.01 |
| 5,461,425 | A * | 10/1995 | Fowler | H04N 3/155 250/208.1 |
| 5,751,263 | A | 5/1998 | Huang et al. | |
| 6,021,172 | A * | 2/2000 | Fossum | G11C 19/282 257/239 |
| 6,392,616 | B1 * | 5/2002 | Suzuki | G09G 3/2037 345/208 |
| 6,410,940 | B1 | 6/2002 | Jiang et al. | |
| 6,597,371 | B2 | 7/2003 | Mandl | |
| 8,258,450 | B1 * | 9/2012 | Fries | G01N 21/6454 250/208.1 |

(Continued)

OTHER PUBLICATIONS

Greer, Trey, et al. "Hybrid Modulation for Near Zero Display Latency"; Society for Information Display, International Symposium, Digest of Technical Papers, vol. 47, Issue 1, May 2016, 3 pages.

(Continued)

*Primary Examiner* — Fred Tzeng

(74) *Attorney, Agent, or Firm* — Hanley, Flight & Zimmerman, LLC

(57) ABSTRACT

In one example, a system for driving current includes a digital pulse density modulation circuit to provide an output in response to pixel data. The system also includes an analog circuit to drive current to increase a brightness in one or more light-emitting diodes in response to the output from the digital pulse density modulation circuit.

18 Claims, 7 Drawing Sheets

(56) References Cited

U.S. PATENT DOCUMENTS 9,369,651 B2* 6/2016 Petilli ..... H04N 5/357
9,818,338 B2 11/2017 Ruan et al.
2003/0090447 A1 5/2003 Kimura
2004/0129933 A1 7/2004 Nathan et al.
2004/0201556 A1 10/2004 Oomori et al.
2005/0012686 A1 1/2005 Osame et al.
2005/0052373 A1 3/2005 Devos et al.
2005/0067971 A1 3/2005 Kane
2005/0200572 A1 9/2005 Weng
2005/0248583 A1* 11/2005 Gotoda ..... G09G 3/2051 345/596
2006/0139343 A1* 6/2006 Choi ..... G09G 3/3275 345/204
2007/0115226 A1 5/2007 Jung et al.
2008/0036708 A1 2/2008 Shirasaki et al.
2008/0239124 A1* 10/2008 Mori ..... H04N 3/155 348/308
2008/0284691 A1* 11/2008 Chung ..... G09G 3/3291 345/76
2008/0291125 A1 11/2008 Yamashita et al.
2008/0303804 A1 12/2008 Schmidt et al.
2009/0289823 A1* 11/2009 Chae ..... H03M 3/384 341/143
2009/0295956 A1* 12/2009 Chae ..... H03H 17/0664 348/294
2010/0181507 A1* 7/2010 Maruyama ..... H04N 1/02815 250/552
2011/0018787 A1 1/2011 Nakamura et al.
2011/0068689 A1* 3/2011 Scenini ..... H05B 45/20 315/77
2011/0074758 A1 3/2011 Wacyk et al.
2011/0128278 A1 6/2011 Schalberger et al.
2011/0210958 A1 9/2011 Yoo et al.
2012/0049762 A1* 3/2012 Khalid ..... B41J 2/451 315/294
2012/0162667 A1* 6/2012 Matsuo ..... G06K 15/1209 358/1.1
2012/0218314 A1 8/2012 Purdy et al.
2013/0207957 A1 8/2013 Lin et al.
2014/0078191 A1* 3/2014 Yang ..... G09G 3/32 345/690
2015/0077615 A1 3/2015 Yamazaki et al.
2016/0141327 A1* 5/2016 Verdant ..... H01L 27/14612 250/208.1
2016/0189618 A1 6/2016 Park et al.
2016/0260375 A1 9/2016 Ruan et al.
2017/0039926 A1* 2/2017 Greer, III ..... G09G 3/2014
2017/0111056 A1* 4/2017 Tkachev ..... H03M 3/462
2017/0126245 A1* 5/2017 Shem ..... H03M 3/462
2017/0131143 A1* 5/2017 Andreou ..... G01J 1/44

OTHER PUBLICATIONS

Jang, Jae Hyuk, et al. "A Digital Driving Technique for an 8 AVGA AMOLED Display Using ΔΣ Modulation"; 2009 IEEE International Solid-State Circuits Conference—Digest of Technical Papers, Feb. 2009, 3 pages.

* cited by examiner

DISPLAY DRIVER

CROSS-REFERENCE TO RELATED APPLICATIONS

This application is related to U.S. patent application Ser. No. 15/387,963, filed on Dec. 22, 2016, titled "Digital Driver for Displays". This application is also related to U.S. patent application Ser. No. 15/387,967, filed on Dec. 22, 2016, titled "Low Power Dissipation Pixel for Displays". This application is also related to U.S. patent application Ser. No. 15/387,979, filed on Dec. 22, 2016, titled "Current Programmed Pixel Architecture for Displays".

TECHNICAL FIELD

This disclosure relates generally to a display driver.

BACKGROUND

Displays based on organic light-emitting diodes (also referred to as OLEDs) and based on inorganic micro light-emitting diodes (also referred to as micro LEDs or μLEDs) have attracted increasing attention for applications in emerging portable electronics and wearable computers (for example, head mounted displays, head worn displays, wristwatches, wearable watch displays, virtual reality displays, augmented reality displays, OLED displays, micro LED displays, etc).

BRIEF DESCRIPTION OF THE DRAWINGS

The following detailed description may be better understood by referencing the accompanying drawings, which contain specific examples of numerous features of the disclosed subject matter.

In some cases, the same numbers may be used throughout the disclosure and the figures to reference like components and features. In some cases, numbers in the 100 series refer to features originally found in FIG. 1; numbers in the 200 series refer to features originally found in FIG. 2; and so on.

DESCRIPTION OF THE EMBODIMENTS

Some embodiments relate to displays, mobile displays and/or light-emitting diode (LED) displays.

As discussed above, displays based on inorganic micro light-emitting diodes (also referred to as micro LEDs or μLEDs) have attracted increasing attention for applications in emerging portable electronics and wearable computers (for example, head mounted displays, head worn displays, wristwatches, wearable watch displays, virtual reality displays, augmented reality displays, OLED displays, micro LED displays, etc). However, it is difficult to scale display digital driving architecture to large displays (and/or displays with a high pixel per inch resolution).

For larger displays such as, for example, 4K displays and/or displays with a high pixel per inch resolution, the pulse width of the luminance signals for LEDs of the display might narrow as the panel size increases (for example, due to an RC bandwidth limitation), and it might become difficult or impossible to drive the display. According to some embodiments, speed and timing associated with digital display driving for large displays (and/or displays with a high pixel per inch resolution) can be optimized. In some embodiments, a mixed signal pulse dense modulation (PDM) architecture is used to provide good performance and avoid limitations such as RC bandwidth limitations. In some embodiments, a mixed signal analog and digital PDM driver is used to drive micro LED displays. In some embodiments, a second order PDM circuit (for example, a second order sigma delta modulator) is use to drive micro LED displays.

Figure 1:
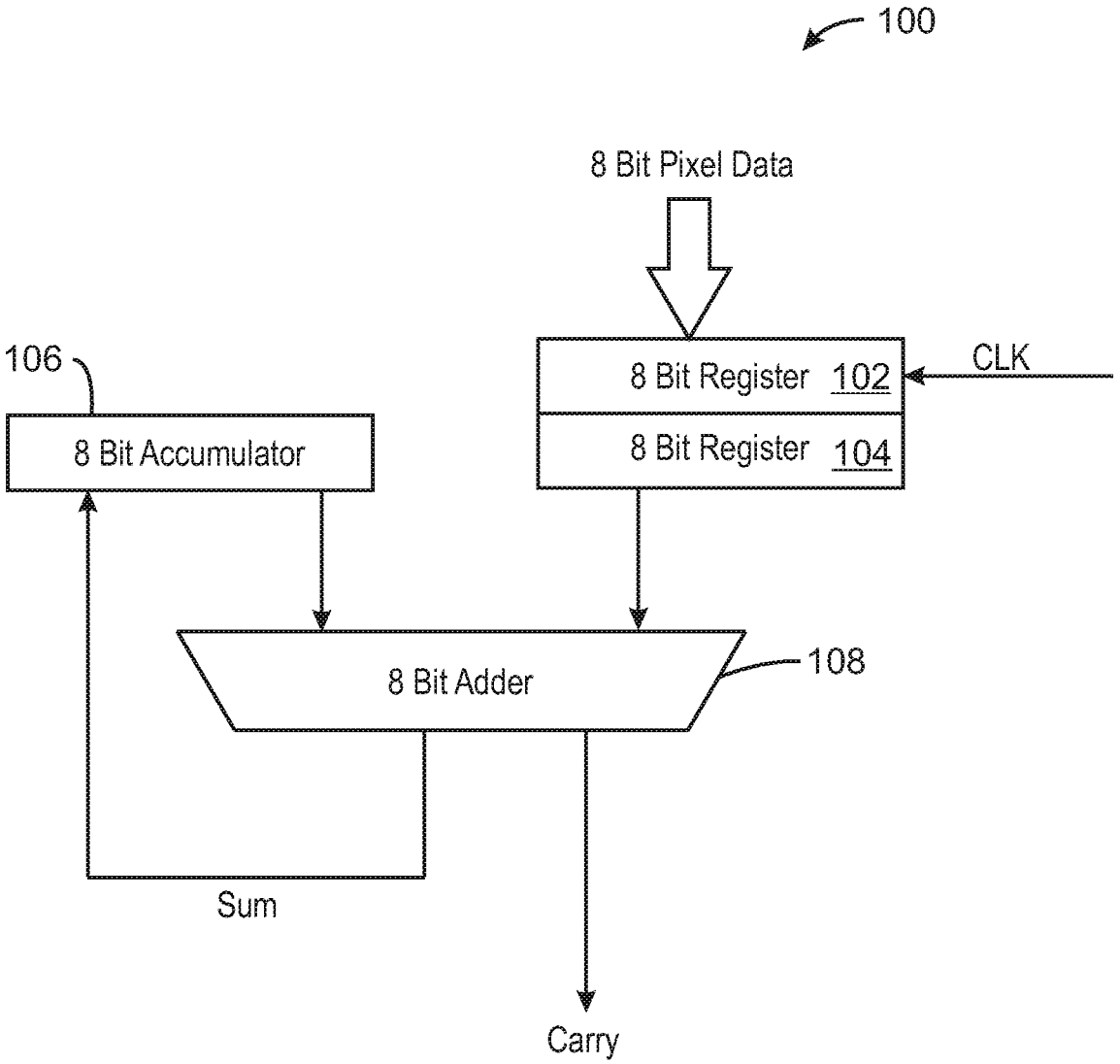
FIG. 1 illustrates an LED digital drive circuit.

FIG. 1 illustrates a digital pulse dense modulation (PDM) circuit 100. PDM circuit 100 includes a shift register including a number of registers, for example, two registers including register 102 and register 104 (for example an 8 bit register 102 and an 8 bit register 104), an accumulator 106 (for example, an 8 bit accumulator 106), and an adder 108 (for example, an 8 bit adder 108). Pixel data (for example, 8 bit pixel data) is input to the registers 102 and 104 in response to a clock signal CLK input to the shift register. In some embodiments, the pixel data input to the shift register (for example, including registers 102 and 104) is a gray level value. Adder 108 adds a previous value held in accumulator 106 with the new value output from the shift register (for example, output from register 104). Adder 108 provides a sum of the held value in accumulator 106 and the new value output from the shift register as well as a carry. In some embodiments, if the sum of the values input to adder 108 exceeds a particular value (for example, in an 8 bit adder implementation of some embodiments, if the value exceeds $2^8$ or 255), then the carry provides a signal (for example, a one bit carry signal). The sum from adder 108 is then stored in accumulator 106, which is to be provided to the adder 108 as an input along with the next value output from the shift register. It is noted that the value that triggers a carry signal output from adder 108 has been described with an example as exceeding a particular value, according to some embodiments the carry signal can be generated in some other manner. In some embodiments, a carry signal is generated as the result of the sum output by adder 108 being greater than 255. In some embodiments, a carry signal is generated by the sum output by adder 108 being greater than any value. In some embodiments, a carry signal is generated in some other manner than the sum being greater than a value. In some embodiments, the carry signal output from circuit 100 is an indication of a change in pixel gray levels.

Figure 2:
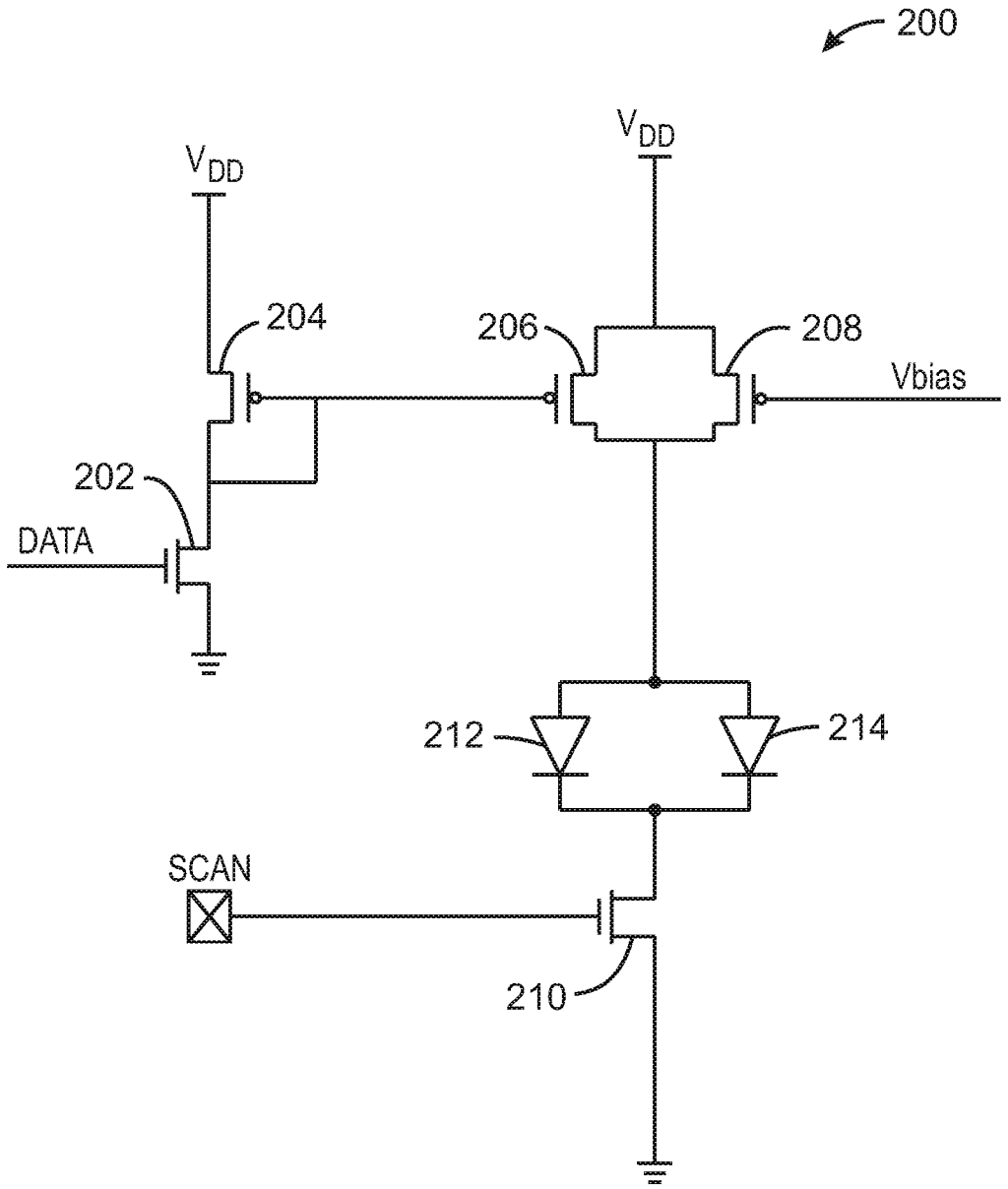
FIG. 2 illustrates an LED drive circuit.

FIG. 2 illustrates an analog pulse dense modulation (PDM) LED driver circuit 200. Circuit 200 includes a transistor 202 (for example, an n channel metal oxide semiconductor transistor, or nMOS transistor), a transistor 204 (for example, a p channel metal oxide semiconductor transistor, or pMOS transistor), a transistor 206 (for example, a pMOS transistor), a transistor 208 (for example, a pMOS transistor), and a transistor 210 (for example, an nMOS transistor). Circuit 200 additionally includes an LED 212 (for example, an OLED or a micro LED) and an LED 214 (for example, an OLED or a micro LED). As illustrated in FIG. 2, in some embodiments transistors 202 and 210 are nMOS transistors and transistors 204, 206 and 208 are pMOS transistors. In some embodiments, transistors 202, 204, 206 and 208 are implemented using CMOS (complementary metal oxide semiconductor) technology. In some embodiments, transistor 210, LED 212 and LED 214 are implemented using thin film transistor (TFT) technology.

In some embodiments, driver circuit 200 handles multiple LEDs 212 and 214, and drives current to both of those LEDs. In some embodiments, redundant LEDs (such as, for example, micro LEDs or OLEDs) may be implemented. For example, redundant LEDs may be used where those redundant LEDs (such as LEDs 212 and 214) together provide brightness for a single pixel (and/or single color for each pixel) in a display array of pixels (for example, a mobile display array of pixels and/or an LED display array of pixels). In this manner, redundant LEDs may be used to provide a fault tolerance relating to the LEDs and the current that is driving the LEDs based on the input voltage Vbias and the input DATA signal. In this manner, if one LED is dead or not working for some reason, the other LED still provides the same amount of luminance that the two LEDs would have provided in parallel. While two redundant LEDs 212 and 214 have been illustrated and described herein, according to some embodiments, one single LED could be used and current driven to that one single LED, and according to some embodiments, more than two LEDs could be used and current driven to those LEDs (for example, using more than two redundant LEDs). It is noted that embodiments are not limited to two redundant LEDs as illustrated and described herein.

The DATA input to transistor 202 corresponds to the carry output provided from circuit 100. Circuit 200 minimizes the number of times the LED 212 and/or LED 214 need to turn on and off based on the carry output from digital circuit 100, while maintaining a width of a luminance pulse of the LED(s) 212 and/or 214.

The Vbias signal input to transistor 208 is a fixed voltage signal that provides an offset to the luminance output of the LED(s) 212 and/or 214. By using the Vbias voltage input signal, the number of times that the LED(s) 212 and/or 214 need to turn on and off is decreased. In this manner, the pulse width of the LED(s) luminance signal is increased.

As described herein, driving the pulse width can be difficult as the distance size of the signal increases. For example, due to an increased display panel size for larger displays and/or high pixel per inch resolution displays, the pulse width can become very narrow and difficult to send over a long interconnect. In some embodiments, the Vbias voltage signal is used to ensure that there is not a need to turn on and off the LED(s) as many times as in implementations where the Vbias input voltage signal is not used. When it is not necessary to turn the LED(s) on and off many times, in some embodiments, the pulse width of the LED(s) luminance can be increased to a wider value, and can be more easily sent over a long interconnect distance.

In some embodiments, Vbias is a fixed voltage signal. In some embodiments, Vbias is used to shoot the pulse at the LED(s). In some embodiments, the Vbias level is set to a level of 1 (or high) when the input gray level pixel signal input to circuit 100 is zero (for example, the input gray level pixel signal is an 8 bit zero signal or "00000000"). This is accomplished, for example, by setting Vbias in FIG. 2 to a value of "1" when the input gray level pixel signal value is zero, which shuts off transistor 208 and provides no offset to the luminance of the LED(s) 212 and/or 214. In some embodiments, the Vbias level is set to a level of 0 (or low) when the input gray level pixel signal input to circuit 100 is not zero (for example, anything other than an 8 bit zero signal or "00000000"). This is accomplished, for example, by setting Vbias in FIG. 2 to a value of "0" when the input gray level pixel signal value is not zero, which turns on transistor 208 and provides an offset to the luminance of the LED(s) 212 and/or 214. When Vbias is left at a zero voltage (or low voltage), the transistor 208 is turned on and current flows through LED(s) 212 and/or 214.

In some embodiments, at first, DATA is zero voltage (indicating that no carry has occurred), SCAN is zero voltage (indicating the scan period has not yet begun), and Vbias is at a high voltage (or 1) state (which is an off state for Vbias in circuit 100). Before the first DATA pulse, Vbias is turned on by setting it to a low or 0 voltage level in response to an indication that the input gray level pixel signal value is no longer zero. When Vbias is set to a low (or 0) voltage level, transistor 208 is turned on. Once transistor 208 is turned on, an offset luminance is provided through LED(s) 212 and/or 214 due to the Vbias offset, and SCAN is a high voltage (indicating that the scan period has begun), the circuit 200 is ready to receive DATA pulses from the carry signal of digital circuit 100. The carry pulses provided to the DATA input turn current on, which flows through transistors 206 and 208, and provides current to LED(s) 212 and/or 214.

By turning on transistor 208, the LED(s) 212 and/or 214 are biased to a specific offset value. Upon receipt of the carry pulse from circuit 100 (input as the DATA signal in circuit 200), the brightness of the LED(s) 212 and/or 214 is increased. As long as the input pixel signal to circuit 100 is not zero, the Vbias signal provides an offset fixed level to the LED(s) 212 and/or 214. The brightness of LED(s) 212 and/or 214 is at a fixed offset level due to the input Vbias voltage, and then increases when a carry is received from circuit 100 to the input DATA signal in circuit 200.

When a gray level of one is received, for example, via the carry output of circuit 100 and the DATA input of circuit 200, the current source including transistors 202 and 204 is turned on. This creates a single current pulse to the LED(s) 212 and/or 214 in addition to the fixed offset provided by the Vbias input. A new pulse is provided to LED(s) 212 and/or 214 every time a carry is received via the DATA input, and in some embodiments, this carry pulse is provided in addition to the fixed offset value provided by the Vbias voltage. As the brightness level of the input pixel data increases, the number of pulses increases, which provides an overall increase in the brightness level of the LED(s) 212 and/or 214. In some embodiments, the offset provided by Vbias is turned off at a gray level of zero when everything is off (for example, when gray level is zero and/or when it is not during a scan period time where the SCAN signal is off). When the offset is turned on (for example, when SCAN is on and VBias is on due to the gray level value being any value but zero), the brightness of the LED(s) 212 and/or 214 stays at the offset level between pulses provided via the carry and DATA signals, and the signal to light the LED(s) does not need to be pumped as frequently.

In some embodiments, circuit 100 is a digital sigma delta modulator (for example, a first order sigma delta modulator) that is a feedback system taking the existing pixel value and a new pixel value. The existing pixel value and the new pixel value are added, and a carry value (for example, a carry bit) is output. In some embodiments, the carry bit is generated only when the summation is beyond a certain threshold value. For example, for 8 bit pixel data, 256 pixel gray levels may be represented with the 8 bit input pixel data signal. A carry pulse is generated by circuit 100 to provide the data input to circuit 200 in order to generate an additional pulse of the luminance of LEDs 212 and/or 214. The number of pulses (and/or the density of the pulses) indicates a pixel gray level associated with the 256 gray levels. Additionally, according to some embodiments, an offset is created in response to the Vbias input voltage in circuit 200. The Vbias voltage signal ensures that current is flowing to the LEDs 212 and/or 214 during the scan period. In this manner, the LEDs 212 and/or 214 can be turned on the moment a particular gray level is available instead of going back to a zero luminance value and starting over again. The number of times the luminance pulses are provided to the LED(s) 212, 214 depends on the gray level and the carry signal output by circuit 100 and input as the data signal to circuit 200.

In some embodiments, the gray level is offset using, for example, the input voltage Vbias. Since the minimum pulse width associated with a digital driving scheme such as a micro LED driving scheme, for example, is a function of the number of gray levels and the number of rows, as the number of rows in the display increases the pulse width decreases. If the display has a large number of rows, the pulse width becomes very small (for example, below 10 nanoseconds for some large displays). Driving a 10 nanosecond pulse across a long RC interconnect in a display panel is very difficult, and by the end of the interconnect the pulse will no longer look like a pulse. In some embodiments, the LED output (for example, micro LED output or OLED output) is offset using Vbias. In this manner, the number of times that the LED has to turn on and off is decreased, and the pulse width is increased so that the pulse can be driven across a long RC interconnect in the display panel, for example.

In some embodiments, Vbias is not used. In some embodiments, transistor 208 is shut off by leaving Vbias at a high (or 1) level. In some embodiments, Vbias and transistor 208 are not included in circuit 200. In embodiments where Vbias is not used, the carry signal input as DATA into circuit 200 is received and pulses in the brightness of the LED(s) 212 and/or 214 are provided (or pumped) to the LED(s) in response to the DATA signal input to circuit 100 and/or the carry signal output from circuit 100.

Figures 3A, 3B:
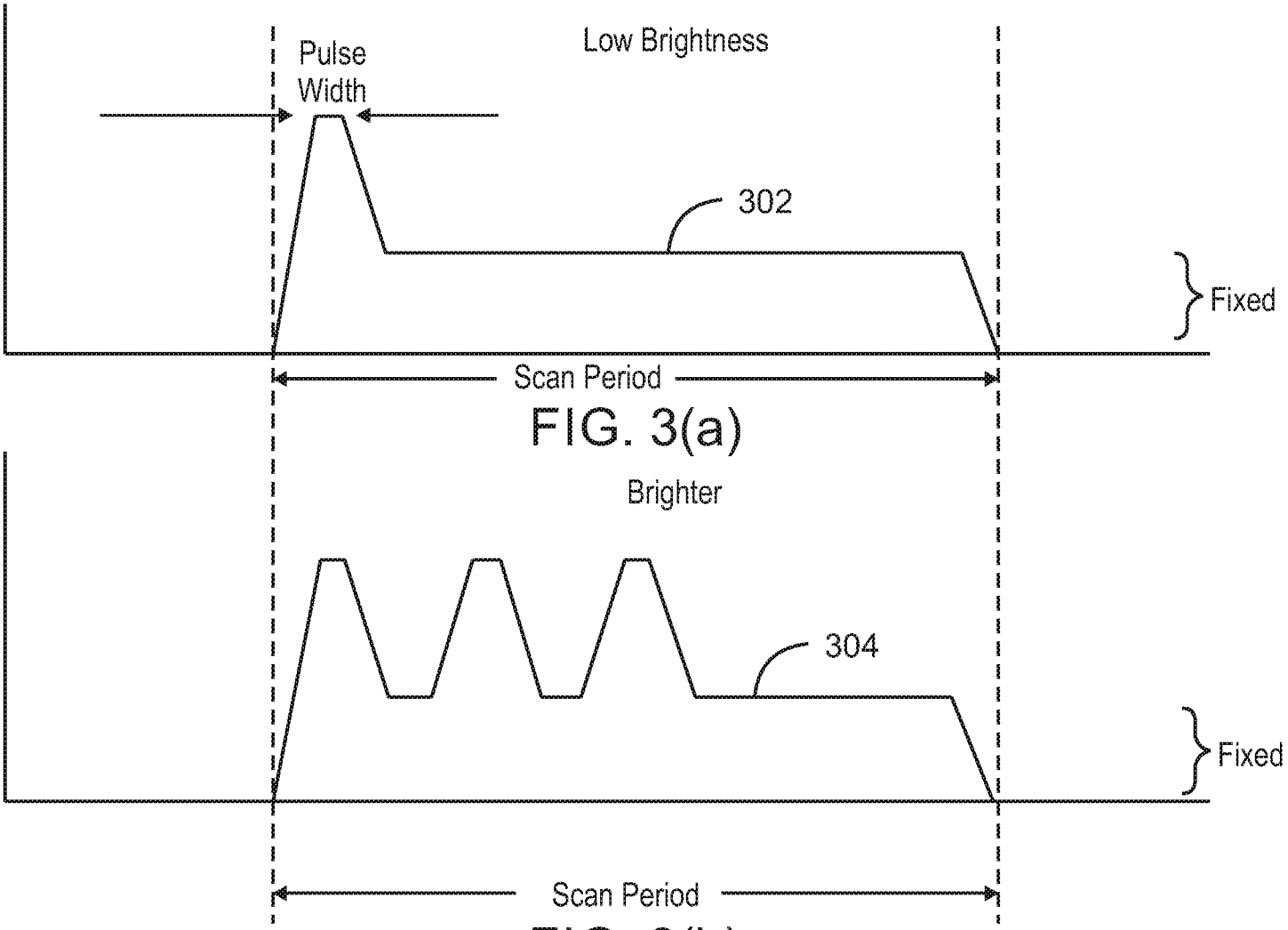
FIG. 3, which includes FIG. 3(*a*) and FIG. 3(*b*), illustrates luminance timing diagrams.

FIG. 3, which includes FIG. 3(*a*) and FIG. 3(*b*), illustrates luminance timing diagrams, for example, with the vertical axes representing luminance or brightness (for example, in nits) and the horizontal axes representing time. FIG. 3(*a*) illustrates a lower brightness signal 302 example and FIG. 3(*b*) illustrates a higher brightness signal 304 example. In some embodiments, the brightness signals 302 and 304 illustrate brightness values of LED(s) 212 and/or 214. Brightness signals 302 and 304 include a brightness signal during one scan period, for example. An offset (for example, a fixed offset) is illustrated in each of signals 302 and 304. These offsets can be provided in some embodiments, for example, using a Vbias voltage to create an offset as described above in reference to FIG. 2. In this manner, the number of times that a pulse needs to be provided to the LED(s) to increase the brightness is decreased, the pulse width is increased, and the number of times that the LED(s) need(s) to be turned on is decreased. In FIG. 3(*a*), one pulse is provided during the scan period (for example, due to one carry and DATA signal provided during the scan period). In FIG. 3(*b*), three pulses are provided during the scan period (for example, due to three carry and DATA signals provided during the scan period). The more times a pulse is provided during the scan period, the higher the average brightness, and the brighter the output of the LED(s).

Figure 4:
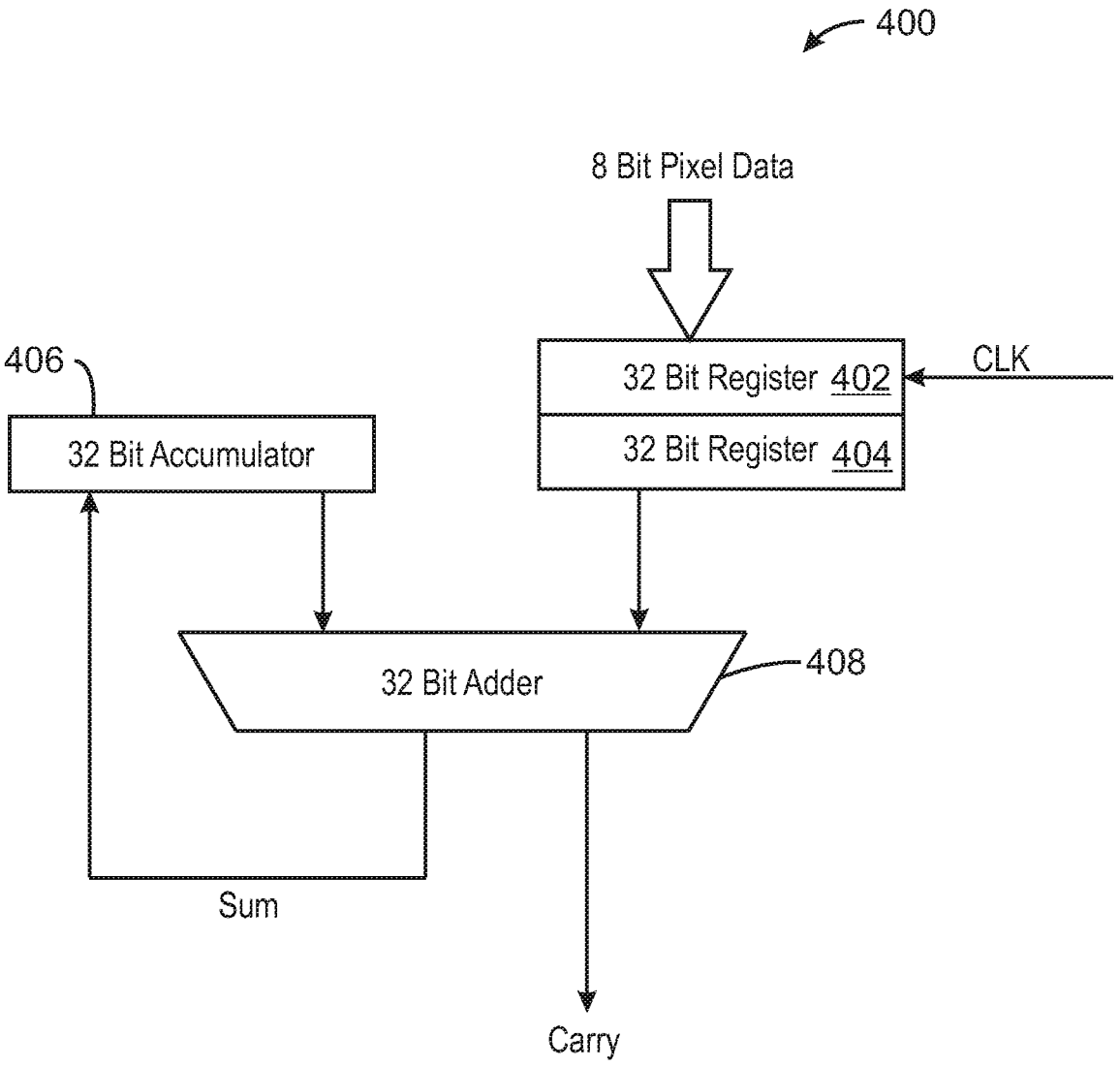
FIG. 4 illustrates an LED digital drive circuit.

FIG. 4 illustrates a digital pulse dense modulation (PDM) circuit 400. PDM circuit 400 includes a shift register including a number of registers, for example, two registers including register 402 and register 404 (for example a 32 bit register 402 and a 32 bit register 404), an accumulator 406 (for example, a 32 bit accumulator 406), and an adder 408 (for example, a 32 bit adder 408). Pixel data (for example, 8 bit pixel data) is input to the registers 402 and 404 in response to a clock signal CLK input to the shift register. In some embodiments, the pixel data input to the shift register (for example, including registers 402 and 404) is a gray level value. Adder 408 adds a previous value held in accumulator 406 with the new value output from the shift register (for example, output from register 404). Adder 408 provides a sum of the held value in accumulator 406 and the new value output from the shift register as well as a carry. In some embodiments, if the sum of the values input to adder 408 exceeds a particular value, then the carry provides a signal (for example, a one bit carry signal). The sum from adder 408 is then stored in accumulator 406, which is to be provided to the adder 408 as an input along with the next value output from the shift register. It is noted that the value that triggers a carry signal output from adder 408 has been described with an example as exceeding a particular value, according to some embodiments the carry signal can be generated in some other manner. In some embodiments, the carry signal output from circuit 400 is an indication of a change in pixel gray levels.

In some embodiments, the size of adder 408 and the memory for the registers 402 and 404 and accumulator 406 is increased by four times relative to adder 208 and the memory for registers 202 and 204 and the accumulator 206. This allows the sampling ratio of circuit 400 to be reduced to one-fourth that of the sampling ratio of circuit 200, and the minimum pulse width using circuit 400 may be increased by four times relative to that of circuit 200. In some embodiments, this additionally helps minimize bandwidth needed to drive the LED signal across the RC interconnect of the display panel.

In some embodiments, the carry output signal from circuit 400 is provided as the DATA input signal in circuit 200. In FIG. 4, instead of being a first order sigma delta modulator such as the sigma delta modulator of some embodiments of FIG. 1, circuit 400 is a second order sigma delta modulator. In some embodiments, in the first order sigma delta modulator of FIG. 1, the number of sampling times is 17. That is, every LED might need to be turned on and off 17 times for the eye of a user to see a gray level that is beneficial for the user to see. In a second order sigma delta modulator according to some embodiments, the number of times that the carry is generated is reduced, and transitions happen once all the additions have taken place. Therefore, instead of sampling 17 times, in some embodiments of FIG. 4, the number of samples may be reduced to a lower number such as 4, significantly decreasing the number of sampling times, and still maintaining sufficient increased minimum pulse width.

Figure 5:
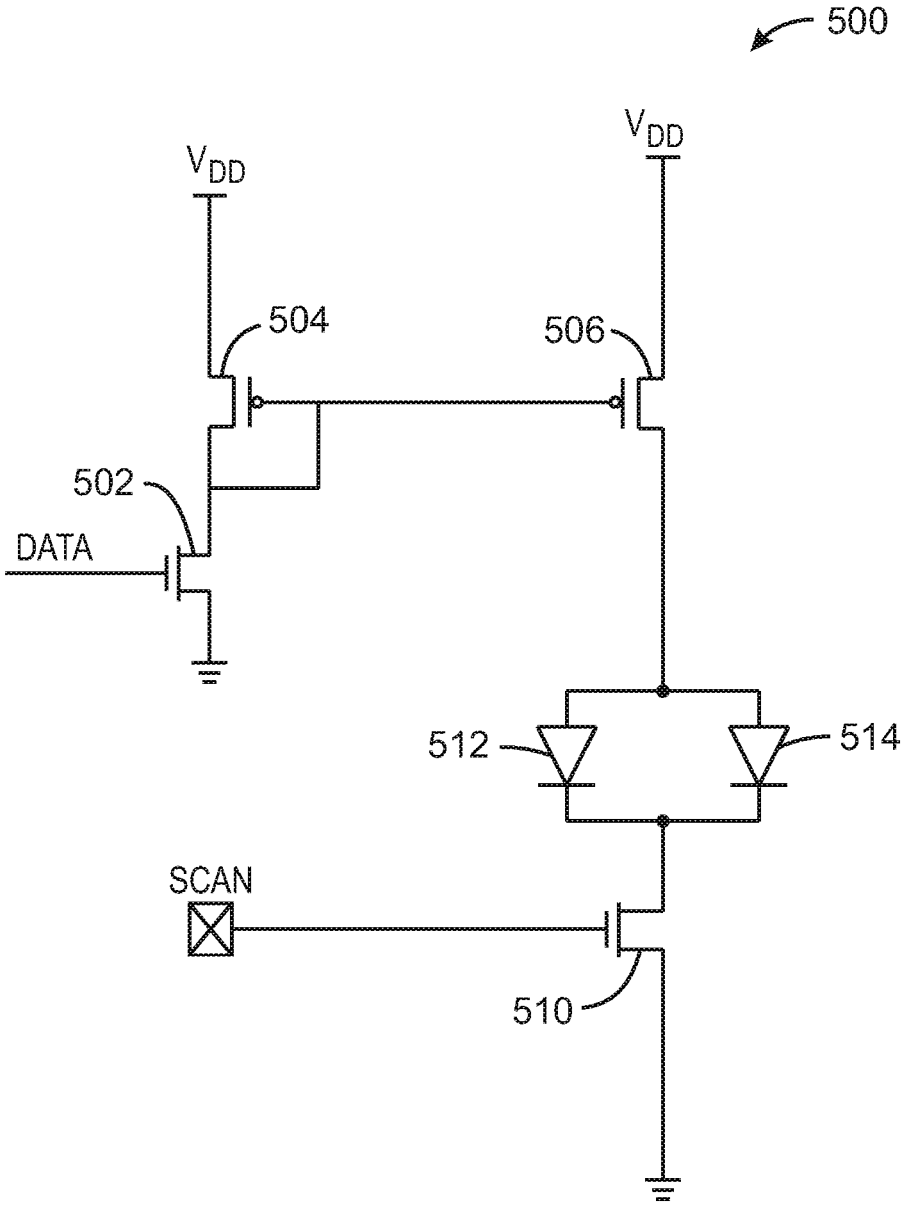
FIG. 5 illustrates an LED drive circuit.

FIG. 5 illustrates an analog pulse dense modulation (PDM) LED driver circuit 500. Circuit 500 includes a transistor 502 (for example, an nMOS transistor), a transistor 504 (for example, a pMOS transistor), a transistor 506 (for example, a pMOS transistor), and a transistor 210 (for example, an nMOS transistor). Circuit 500 additionally includes an LED 512 (for example, an OLED or a micro LED) and an LED 514 (for example, an OLED or a micro LED). As illustrated in FIG. 5, in some embodiments transistors 502 and 510 are nMOS transistors and transistors 504 and 506 are pMOS transistors. In some embodiments, transistors 502, 504 and 506 are implemented using CMOS (complementary metal oxide semiconductor) technology. In some embodiments, transistor 510, LED 512 and LED 514 are implemented using thin film transistor (TFT) technology.

In some embodiments, driver circuit 500 handles multiple LEDs 512 and 514, and drives current to both of those LEDs. In some embodiments, redundant LEDs (such as, for example, OLEDs or micro LEDs) may be implemented. For example, redundant LEDs may be used where those redundant LEDs (such as LEDs 512 and 514) together provide brightness for a single pixel (and/or single color for each pixel) in a display array of pixels (for example, a mobile display array of pixels and/or an LED display array of pixels). In this manner, redundant LEDs may be used to provide a fault tolerance relating to the LEDs and the current that is driving the LEDs based on the input DATA signal. In this manner, if one LED is dead or not working for some reason, the other LED still provides the same amount of luminance that the two LEDs would have provided in parallel. While two redundant LEDs 512 and 514 have been illustrated and described herein, according to some embodiments, one single LED could be used and current driven to that one single LED, and according to some embodiments, more than two LEDs could be used and current driven to those LEDs (for example, using more than two redundant LEDs). It is noted that embodiments are not limited to two redundant LEDs as illustrated and described herein.

In some embodiments, the DATA input to transistor 502 corresponds to the carry output provided from circuit 100 and/or from circuit 400. Circuit 500 minimizes the number of times the LED 512 and/or LED 514 need to turn on and off based on the carry output from digital circuit 100, while maintaining a width of a luminance pulse of the LED(s) 512 and/or 514.

In some embodiments, at first, DATA is zero voltage (indicating that no carry has occurred) and SCAN is zero voltage (indicating the scan period has not yet begun). When SCAN is a high voltage (indicating that the scan period has begun), circuit 500 is ready to receive DATA pulses from the carry signal of digital circuit 100 and/or of digital circuit 400. The carry pulses provided to the DATA input turn current on, which flows through transistor 506, and provides current to LED(s) 212 and/or 214.

Upon receipt of the carry pulse from circuit 100 and/or from circuit 400 (input as the DATA signal in circuit 500), the brightness of the LED(s) 212 and/or 214 is increased and pulses in a similar manner to that described in FIG. 2. However, a Vbias offset value is not provided in the embodiment of FIG. 5.

When a gray level of one is received, for example, via the carry output of circuit 100 and/or circuit 400, and the DATA input of circuit 500, the current source including transistors 502 and 504 is turned on. This creates a single current pulse to the LED(s) 512 and/or 514. A new pulse is provided to LED(s) 512 and/or 514 every time a carry is received via the DATA input in FIG. 5. As the brightness level of the input pixel data increases, the number of pulses increases, which provides an overall increase in the brightness level of the LED(s) 512 and/or 514.

Figure 6:
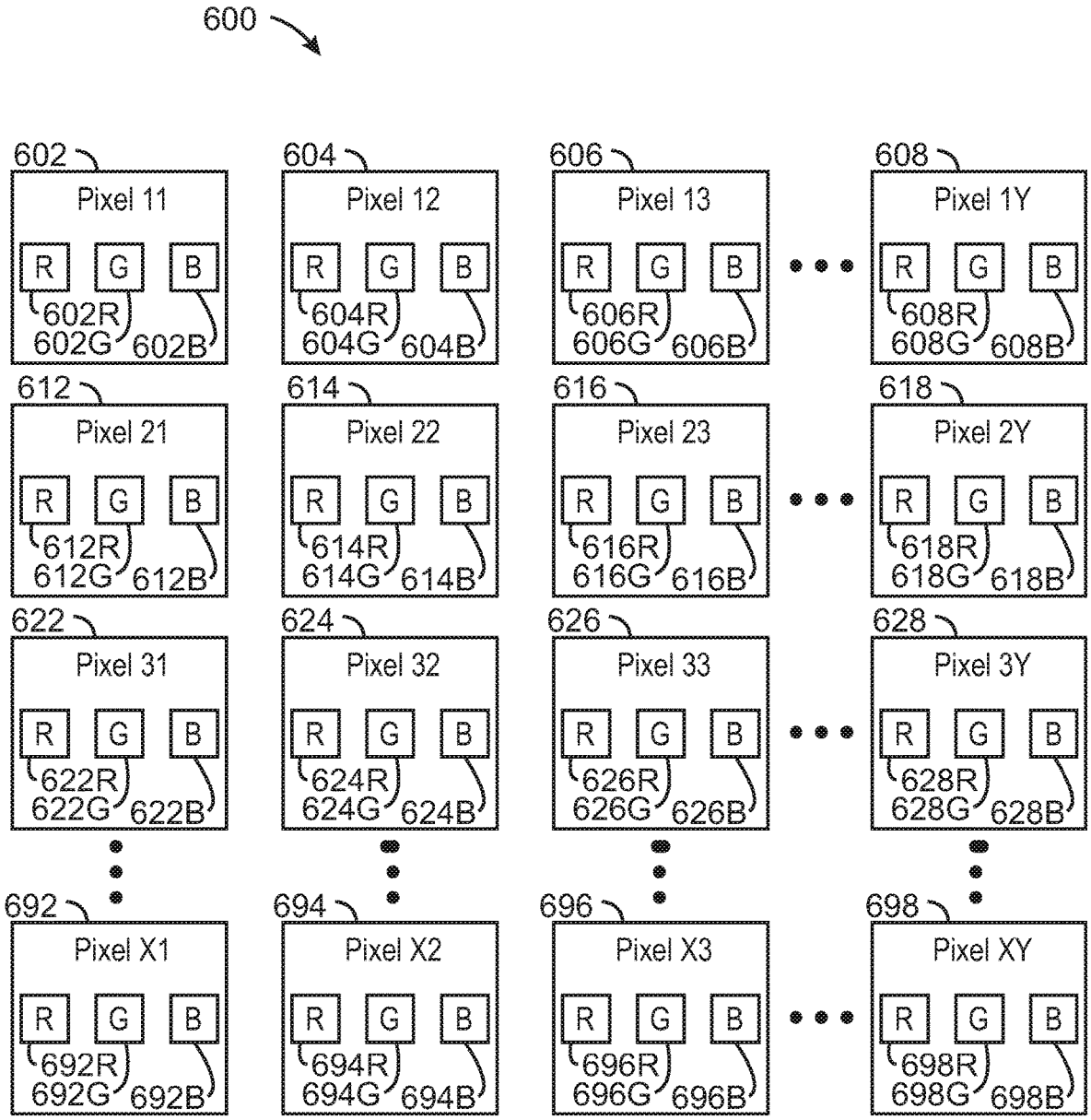
FIG. 6 illustrates a block diagram of a display pixel driving system.

FIG. 6 illustrates a display pixel driver system 600 (for example, a mobile display pixel driver system, an LED pixel driver system, an OLED pixel driver system, and/or a micro LED pixel driver system). Pixel driver system 600 displays pixels in X rows and Y columns. In some embodiments, pixel driver system 600 displays pixels in 400 rows and 400 columns. In some embodiments, pixel driver system 600 displays pixels in 1080 rows and 1920 columns.

Each pixel in the system 600 includes a number of driver circuits. For example, as illustrated in FIG. 6, each pixel includes a driver circuit for each of a number of colors in the driver system (for example, as illustrated in FIG. 6, a separate pixel driver circuit for each of red (R), blue (B), and green (G) pixels). FIG. 6 illustrates Y pixels in each row. Row 1 includes pixel 11 (602) with a red pixel driver circuit 602R, a green pixel driver circuit 602G and a blue pixel driver circuit 602B, pixel 12 (604) with a red pixel driver circuit 604R, a green pixel driver circuit 604G and a blue pixel driver circuit 604B, pixel 13 (606) with a red pixel driver circuit 606R, a green pixel driver circuit 606G and a blue pixel driver circuit 606B, . . . , pixel 1Y (608) with a red pixel driver circuit 608R, a green pixel driver circuit 608G and a blue pixel driver circuit 608B. Row 2 includes pixel 21 (612) with a red pixel driver circuit 612R, a green pixel driver circuit 612G and a blue pixel driver circuit 612B, pixel 22 (614) with a red pixel driver circuit 614R, a green pixel driver circuit 614G and a blue pixel driver circuit 614B, pixel 23 (616) with a red pixel driver circuit 616R, a green pixel driver circuit 616G and a blue pixel driver circuit 616B, . . . , pixel 2Y (618) with a red pixel driver circuit 618R, a green pixel driver circuit 618G and a blue pixel driver circuit 618B. Row 3 includes pixel 31 (622) with a red pixel driver circuit 622R, a green pixel driver circuit 622G and a blue pixel driver circuit 622B, pixel 32 (624) with a red pixel driver circuit 624R, a green pixel driver circuit 624G and a blue pixel driver circuit 624B, pixel 33 (626) with a red pixel driver circuit 626R, a green pixel driver circuit 626G and a blue pixel driver circuit 626B, . . . , pixel 3Y (628) with a red pixel driver circuit 628R, a green pixel driver circuit 628G and a blue pixel driver circuit 628B. Row X includes pixel X1 (692) with a red pixel driver circuit 692R, a green pixel driver circuit 692G and a blue pixel driver circuit 692B, pixel X2 (694) with a red pixel driver circuit 694R, a green pixel driver circuit 694G and a blue pixel driver circuit 694B, pixel X3 (696) with a red pixel driver circuit 696R, a green pixel driver circuit 696G and a blue pixel driver circuit 696B, . . . , pixel XY (698) with a red pixel driver circuit 698R, a green pixel driver circuit 698G and a blue pixel driver circuit 698B.

In some embodiments, one or more of the pixel driver circuits in the system 600 (for example, circuits 602R, 602G, 602B, 604R, 604G, 604B, 606R, 606G, 606B, . . . , 608R, 608G, 608B, 612R, 612G, 612B, 614R, 614G, 614B, 616R, 616G, 616B, . . . , 618R, 618G, 618B, 622R, 622G, 622B, 624R, 624G, 624B, 626R, 626G, 626B, . . . , 628R, 628G, 628B, . . . , 692R, 692G, 692B, 694R, 694G, 694B, 696R, 696G, 696B, . . . , 698R, 698G, 698B) may be implemented using one or more of the circuits 100, 200, 400, and/or 500 described herein. For example, one or more or all of the pixel driver circuits in FIG. 6 might include a combination of circuits 100 and 200, a combination of circuits 100 and 500, a combination of circuits 200 and 400, or a combination of circuits 400 and 500 according to some embodiments.

In some embodiments of FIG. 6, a driver circuit is provided for each pixel in a display. For example, a display with 400 lines and 400 columns would include 160,000 driver circuits times the number of colors. For example, in some embodiments there are three colors in a red green blue (or RGB) system, and 480,000 driver circuits (and in some embodiments, 960,000 LEDs, with two redundant LEDs per driver circuit) for the 400×400 display (160,000 times 3, since each color has a separate driver circuit for each of the pixels in the array).

In some embodiments, a width of a brightness pulse is increased. In some embodiments, a fixed offset is provided to a brightness pulse in a manner such that a number of times that a light source (for example, an LED such as an OLED or a micro LED) needs to be turned on and off is reduced. In some embodiments, this reduction increases the pulse width of the brightness. In some embodiments, this increased pulse width helps to drive pulses across a long interconnect.

In some embodiments, the carry signal and/or DATA signal are toggled more times to provide more pulses. As the number of carry signals output by circuit 200 and/or 500 are increased, the number of pulses provided to the LED(s) increases, and the overall average brightness of the LED(s) is higher. In some embodiments, the digital and analog driving circuits (for example, circuits 100, 200, 400, 500, and/or the driving circuits included in system 600) can be designed and/or adjusted to provide more or less pulses depending, for example, on user preference.

In some embodiment, a fixed current is provided to one or more LED(s), for example, using a voltage such as the Vbias voltage described herein. In some embodiments, digital driving (for example, using circuits 100 and/or 400) is combined with an analog circuit (for example, using circuits 200 and/or 500). In some embodiments, the analog circuit includes a bias voltage driving current through one or more LED(s). In this manner, according to some embodiments, a fixed current is turned on to provide a bias and/or an offset in the brightness, which can be combined with digital driving of the LED(s).

In some embodiments, techniques described herein such as digital driving and/or providing an offset in current driven through and/or brightness of LED(s) may be used in a display for a virtual reality system. In some embodiments, techniques described herein such as digital driving and/or providing an offset in current driven through and/or brightness of LED(s) may be used in an LED display (for example, an OLED display or a micro LED display). In some embodiments, techniques described herein such as digital driving and/or providing an offset in current driven through and/or brightness of LED(s) may be used in a large display, a display with high resolution, and/or a display with high pixel per inch resolution.

In some embodiments, combinations of circuit 100 and 200, circuit 100 and 500, circuit 200 and 400, and/or circuit 400 and 500, etc. together provide a mixed signal analog and digital pulse density modulation circuit (for example, to drive current through a light source such as one or more LED, one or more OLED, and/or one or more micro LED).

Figure 7:
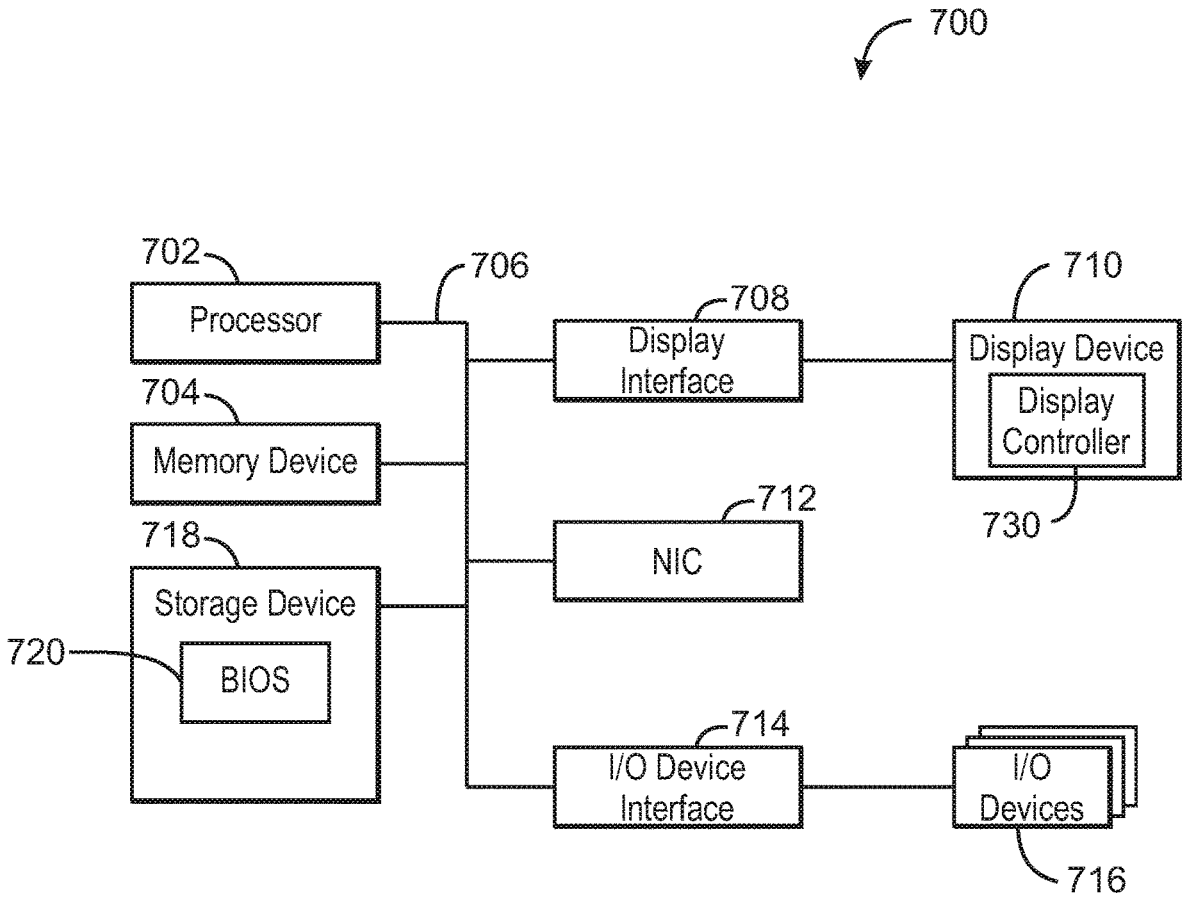
FIG. 7 illustrates a block diagram of a computing device.

FIG. 7 is a block diagram of an example of a computing device 700 that can drive pixels in a display. In some embodiments, any portion of the circuits and/or systems illustrated in any one or more of FIGS. 1-6, and any of the embodiments described herein can be included in and/or be implemented by computing device 700. The computing device 700 may be, for example, a mobile phone, mobile device, handset, laptop computer, desktop computer, or tablet computer, among others. The computing device 700 may include a processor 702 that is adapted to execute stored instructions, as well as a memory device 704 (and/or storage device 704) that stores instructions that are executable by the processor 702. The processor 702 can be a single core processor, a multi-core processor, a computing cluster, or any number of other configurations. For example, processor 702 can be an Intel® processor such as an Intel® Celeron, Pentium, Core, Core i3, Core i5, or Core i7 processor. In some embodiments, processor 702 can be an Intel® x86 based processor. In some embodiments, processor 702 can be an ARM based processor. The memory device 704 can be a memory device and/or a storage device, and can include volatile storage, non-volatile storage, random access memory, read only memory, flash memory, or any other suitable memory or storage systems. The instructions that are executed by the processor 702 may also be used to implement display driver control as described in this specification.

The processor 702 may also be linked through the system interconnect 706 (e.g., PCI®, PCI-Express®, NuBus, etc.) to a display interface 708 adapted to connect the computing device 700 to a display device 710. The display device 710 may include a display screen that is a built-in component of the computing device 700. The display device 710 may also include a computer monitor, television, or projector, among others, that is externally connected to the computing device 700. The display device 710 can include light emitting diodes (LEDs), organic light emitting diodes (OLEDs), and/or micro-LEDs, among others.

In some embodiments, the display interface 708 can include any suitable graphics processing unit, transmitter, port, physical interconnect, and the like. In some examples, the display interface 708 can implement any suitable protocol for transmitting data to the display device 710. For example, the display interface 708 can transmit data using a high-definition multimedia interface (HDMI) protocol, a DisplayPort protocol, or some other protocol or communication link, and the like In some embodiments, display device 710 includes a display controller 730. In some embodiments, the display controller 730 can provide control signals within and/or to the display device 710. In some embodiments, display controller 730 can be included in the display interface 708 (and/or instead of the display interface 708). In some embodiments, display controller 730 can be coupled between the display interface 708 and the display device 710. In some embodiments, the display controller 730 can be coupled between the display interface 708 and the interconnect 706. In some embodiments, the display controller 730 can be included in the processor 702. In some embodiments, display controller 730 can implement driving of display pixels as described herein (for example, as illustrated in and described in reference to any of the circuits and/or systems of FIGS. 1-6). In some embodiments, display controller 730 and/or display device 710 can include a display driver pixel system such as system 400 of FIG. 4. In some embodiments, a driver circuit (for example, such as driver circuit 100 of FIG. 1, driver circuit 200 of FIG. 2, and/or driver circuit 300 of FIG. 3) is provided for one or more pixel (or each pixel) in a display, and is included in display device 710 and/or display controller 730.

In addition, a network interface controller (also referred to herein as a NIC) 712 may be adapted to connect the computing device 700 through the system interconnect 706 to a network (not depicted). The network (not depicted) may be a cellular network, a radio network, a wide area network (WAN), a local area network (LAN), or the Internet, among others.

The processor 702 may be connected through system interconnect 706 to an input/output (I/O) device interface 714 adapted to connect the computing host device 700 to one or more I/O devices 716. The I/O devices 716 may include, for example, a keyboard and/or a pointing device, where the pointing device may include a touchpad or a touchscreen, among others. The I/O devices 716 may be built-in components of the computing device 700, or may be devices that are externally connected to the computing device 700.

In some embodiments, the processor 702 may also be linked through the system interconnect 706 to a storage device 718 that can include a hard drive, a solid state drive (SSD), a magnetic drive, an optical drive, a USB flash drive, an array of drives, or any other type of storage, including combinations thereof. In some embodiments, the storage device 718 can include any suitable applications. In some embodiments, the storage device 718 can include a basic input/output system (BIOS) 720.

It is to be understood that the block diagram of FIG. 7 is not intended to indicate that the computing device 700 is to include all of the components shown in FIG. 7. Rather, the computing device 700 can include fewer or additional components not illustrated in FIG. 7 (e.g., additional memory components, embedded controllers, additional modules, additional network interfaces, etc.). Furthermore, any of the functionalities of the BIOS 720 may be partially, or entirely, implemented in hardware and/or in the processor 702. For example, the functionality may be implemented with an application specific integrated circuit, logic implemented in an embedded controller, or in logic implemented in the processor 702, among others. In some embodiments, the functionalities of the BIOS 720 can be implemented with logic, wherein the logic, as referred to herein, can include any suitable hardware (e.g., a processor, among others), software (e.g., an application, among others), firmware, or any suitable combination of hardware, software, and firmware.

Reference in the specification to "one embodiment" or "an embodiment" or "some embodiments" of the disclosed subject matter means that a particular feature, structure, or characteristic described in connection with the embodiment is included in at least one embodiment of the disclosed subject matter. Thus, the phrase "in one embodiment" or "in some embodiments" may appear in various places throughout the specification, but the phrase may not necessarily refer to the same embodiment or embodiments.

Example 1

In some examples, a system for driving current includes a digital pulse density modulation circuit and an analog circuit. The digital pulse density modulation circuit is to provide an output in response to pixel data corresponding to one or more pixels in a display. The analog circuit is to drive current to increase a brightness in one or more light-emitting diodes in response to the output from the digital pulse density modulation circuit.

Example 2

In some examples, the system of EXAMPLE 1, where the digital pulse density modulation circuit is a sigma delta modulator.

Example 3

In some examples, the system of EXAMPLE 2, where the sigma delta modulator is a second order sigma delta modulator.

Example 4

In some examples, the system of EXAMPLE 1, where the analog circuit is to drive a fixed offset current to increase the brightness in the one or more light-emitting diodes. The analog circuit is also to drive additional current through the one or more light-emitting diodes in addition to the fixed offset current in response to the output from the digital pulse density modulation circuit.

Example 5

In some examples, the system of EXAMPLE 4, where the fixed offset current is provided in response to a bias voltage. The bias voltage is provided in response to the pixel data.

Example 6

In some examples, the system of EXAMPLE 1, where the digital pulse density modulation circuit includes an adder to add accumulated pixel data signals. The adder is to provide a carry signal as the output of the digital pulse density modulation circuit.

Example 7

In some examples, a method for driving current includes performing digital pulse density modulation and driving current. The digital pulse density modulation is performed in response to pixel data corresponding to one or more pixels in a display. The current is driven to increase a brightness in one or more light-emitting diodes in response to the digital pulse density modulation.

Example 8

In some examples, the method of EXAMPLE 7, where the digital pulse density modulation is sigma delta modulation.

Example 9

In some examples, the method of EXAMPLE 8, where the sigma delta modulation is second order sigma delta modulation.

Example 10

In some examples, the method of EXAMPLE 7, where the current driving is performed in an analog manner.

Example 11

In some examples, the method of EXAMPLE 7, including driving a fixed offset current and driving additional current. The fixed offset current is driven to increase the brightness in the one or more light-emitting diodes. The additional current is driven through the one or more light-emitting diodes in addition to the fixed offset current in response to the digital pulse density modulation.

Example 12

In some examples, the method of EXAMPLE 11, including providing the fixed offset current in response to a bias voltage that is responsive to the pixel data.

Example 13

In some examples, the method of EXAMPLE 7, where the digital pulse density modulation includes adding accumulated pixel data signals and providing a carry signal. Current is driven to increase the brightness in the one or more light-emitting diodes in response to the carry signal.

Example 14

In some examples, a system for driving current includes a circuit to drive a fixed offset current. The fixed offset current is to increase an average brightness in one or more light-emitting diodes in response to pixel data corresponding to one or more pixels in a display.

Example 15

In some examples, the system of EXAMPLE 14, where the fixed offset current is provided in response to a bias voltage that is responsive to the pixel data.

Example 16

In some examples, a light-emitting diode display system includes a plurality of pixel driving circuits. The pixel driving circuits are to each drive current through one or more corresponding light-emitting diodes in a display. At least one of the pixel driving circuits includes a digital pulse density modulation circuit and an analog circuit. The digital pulse density modulation circuit is to provide an output in response to pixel data corresponding to one or more pixels in the display. The analog circuit is to drive current to increase a brightness in the corresponding one or more light-emitting diodes in response to the output from the digital pulse density modulation circuit.

Example 17

In some examples, the system of EXAMPLE 16, where each of the pixel driving circuits includes a digital pulse modulation circuit and an analog circuit. Each digital pulse density modulation circuit is to provide an output in response to pixel data. Each analog circuit is to drive current to increase a brightness in the corresponding one or more light-emitting diodes in response to the output from the digital pulse density modulation circuit.

Example 18

In some examples, the system of EXAMPLE 16, where the digital pulse density modulation circuit is a sigma delta modulator.

Example 19

In some examples, the system of EXAMPLE 18, where the sigma delta modulator is a second order sigma delta modulator.

Example 20

In some examples, the system of EXAMPLE 16, where the analog circuit is to drive a fixed offset current to increase the brightness in the corresponding one or more light-emitting diodes. The analog circuit is also to drive additional current through the corresponding one or more light-emitting diodes in addition to the fixed offset current in response to the output from the digital pulse density modulation circuit.

Example 21

In some examples, the system of EXAMPLE 20, where the fixed offset current is provided in response to a bias voltage provided in response to the pixel data.

Example 22

In some examples, the system of EXAMPLE 16, where the digital pulse density modulation circuit includes an adder. The adder is to add accumulated pixel data signals. The adder is also to provide a carry signal as the output of the digital pulse density modulation circuit.

Example 23

In some examples, a system for driving current includes a digital pulse density modulation circuit and an analog circuit. The digital pulse density modulation circuit is to provide an output in response to pixel data corresponding to one or more pixels in a display. The analog circuit is to drive current to increase a brightness in one or more light-emitting diodes in response to the output from the digital pulse density modulation circuit.

Example 24

In some examples, the system of EXAMPLE 23, where the digital pulse density modulation circuit is a sigma delta modulator.

Example 25

In some examples, the system of EXAMPLE 24, where the sigma delta modulator is a second order sigma delta modulator.

Example 26

In some examples, the system of EXAMPLE 23, where the digital pulse density modulation circuit includes an adder. The adder is to add accumulated pixel data signals and to provide a carry signal as the output of the digital pulse density modulation circuit.

Example 27

In some examples, the system of any of EXAMPLES 23-26, where the analog circuit is to drive a fixed offset current to increase the brightness in the one or more light-emitting diodes. The analog circuit is also to drive additional current through the one or more light-emitting diodes in addition to the fixed offset current in response to the output from the digital pulse density modulation circuit.

Example 28

In some examples, the system of EXAMPLE 27, where the fixed offset current is provided in response to a bias voltage. The bias voltage is provided in response to the pixel data.

Example 29

In some examples, a method for driving current includes performing pulse density modulation and driving current. The digital pulse density modulation is performed in response to pixel data corresponding to one or more pixels in a display. The current is driven to increase a brightness in one or more light-emitting diodes in response to the digital pulse density modulation.

Example 30

In some examples, the method of EXAMPLE 29, where the digital pulse density modulation is sigma delta modulation.

Example 31

In some examples, the method of EXAMPLE 30, where the sigma delta modulation is second order sigma delta modulation.

Example 32

In some examples, the method of EXAMPLE 29, where the current driving is performed in an analog manner.

Example 33

In some examples, the method of EXAMPLE 29, where the digital pulse density modulation includes adding accumulated pixel data signals and providing a carry signal. Current is driven to increase the brightness in the one or more light-emitting diodes in response to the carry signal.

Example 34

In some examples, the method of any of EXAMPLES 29-33, including driving a fixed offset current to increase the brightness in the one or more light-emitting diodes. Additional current is driven through the one or more light-emitting diodes in addition to the fixed offset current in response to the digital pulse density modulation.

Example 35

In some examples, the method of EXAMPLE 34, including providing the fixed offset current in response to a bias voltage that is responsive to the pixel data.

Example 36

In some examples, a system for driving current, including a circuit to drive a fixed offset current to increase an average brightness in one or more light-emitting diodes. The fixed offset current is driven in response to pixel data corresponding to one or more pixels in a display.

Example 37

In some examples, the system of EXAMPLE 36, where the fixed offset current is provided in response to a bias voltage that is responsive to the pixel data.

Example 38

In some examples, a light-emitting diode display system includes a plurality of pixel driving circuits. The pixel driving circuits are each to drive current through one or more corresponding light-emitting diodes in a display. One or more of the pixel driving circuits include a digital pulse density modulation circuit and an analog circuit. The digital pulse density modulation circuit is to provide an output in response to pixel data corresponding to one or more pixels in the display. The analog circuit is to drive current to increase a brightness in the corresponding one or more light-emitting diodes in response to the output from the digital pulse density modulation circuit.

Example 39

In some examples, the system of EXAMPLE 38, where each of the pixel driving circuits includes a digital pulse density modulation circuit and an analog circuit. The digital pulse density modulation circuit is to provide an output in response to pixel data. The analog circuit is to drive current to increase a brightness in the corresponding one or more light-emitting diodes in response to the output from the digital pulse density modulation circuit.

Example 40

In some examples, the system of EXAMPLE 38, where the digital pulse density modulation circuit is a sigma delta modulator.

Example 41

In some examples, the system of EXAMPLE 40, where the sigma delta modulator is a second order sigma delta modulator.

Example 42

In some examples, the system of EXAMPLE 38, where the digital pulse density modulation circuit includes an adder to add accumulated pixel data signals and to provide a carry signal as the output of the digital pulse density modulation circuit.

Example 43

In some examples, the system of any of EXAMPLES 38-42, where the analog circuit is to drive a fixed offset current to increase the brightness in the corresponding one or more light-emitting diodes. The analog circuit is also to drive additional current through the corresponding one or more light-emitting diodes in addition to the fixed offset current in response to the output from the digital pulse density modulation circuit.

Example 44

In some examples, the system of EXAMPLE 43, where the fixed offset current is provided in response to a bias voltage. The bias voltage is provided in response to the pixel data.

Example 45

In some examples, a system for driving current includes means for performing digital pulse density modulation and analog means. The means for performing digital pulse density modulation performs digital pulse density modulation in response to pixel data corresponding to one or more pixels in a display. The analog means is for driving current to increase a brightness in one or more light-emitting diodes in response to the means for performing digital pulse density modulation.

Example 46

In some examples, the system of EXAMPLE 45, including means for adding accumulated pixel data signals. The system also includes means for providing to the analog means a carry signal of the means for adding as an output of the means for performing digital pulse density modulation.

Example 47

In some examples, the system of EXAMPLE 45 or 46, including means for driving a fixed offset current to increase the brightness in the one or more light-emitting diodes. The system also includes means for driving additional current through the one or more light-emitting diodes in addition to the fixed offset current in response to the digital pulse density modulation.

Example 48

In some examples, a method for driving current includes performing digital pulse density modulation in response to pixel data corresponding to one or more pixels in a display. The method also includes driving current to increase a brightness in one or more light-emitting diodes in response to the digital pulse density modulation.

Example 49

In some examples, the method of EXAMPLE 48, where the digital pulse density modulation is sigma delta modulation.

Example 50

In some examples, the method of EXAMPLE 49, where the sigma delta modulation is second order sigma delta modulation.

Example 51

In some examples, the method of any of EXAMPLES 48-50, where the current driving is performed in an analog manner.

Example 52

In some examples, the method of any of EXAMPLES 48-51, including driving a fixed offset current and driving additional current. The fixed offset current is to increase the brightness in the one or more light-emitting diodes. The additional current is driven through the one or more light-emitting diodes in addition to the fixed offset current and in response to the digital pulse density modulation.

Example 53

In some examples, the method of EXAMPLE 52, including providing the fixed offset current in response to a bias voltage. The bias voltatge is responsive to the pixel data.

Example 54

In some examples, the method of any of EXAMPLES 48-53, where the digital pulse density modulation includes adding accumulated pixel data signals and providing a carry signal. The method includes driving current to increase the brightness in the one or more light-emitting diodes in response to the carry signal.

Example 55

In some examples, the method of any of EXAMPLES 48-54, including for each pixel in the display, performing digital pulse density modulation and driving current. For each pixel, digital pulse density modulation is performed in response to pixel data corresponding to that respective pixel. For each pixel, in response to the digital pulse density modulation, current is driven to increase a brightness in one or more light-emitting diodes corresponding to the respective pixel.

Example 56

In some examples, the method of EXAMPLE 55, where the digital pulse density modulation for each pixel is sigma delta modulation.

Example 57

In some examples, the method of EXAMPLE 56, where the sigma delta modulation for each pixel is second order sigma delta modulation.

Example 58

In some examples, the method of any of EXAMPLES 55-57, wherein the current driving for each pixel is performed in an analog manner.

Example 59

In some examples, the method of any of EXAMPLES 55-58, including for each pixel in the display driving a fixed offset current and driving additional current. The fixed offset current is driven for each pixel to increase the brightness in the one or more light-emitting diodes corresponding to the respective pixel. The additional current is driven for each pixel through the one or more light-emitting diodes corresponding to the respective pixel in addition to the fixed offset current in response to the digital pulse density modulation for that pixel.

Example 60

In some examples, the method of EXAMPLE 59, including for each pixel providing the fixed offset current in response to a bias that is responsive to the pixel data for that pixel.

Example 61

In some examples, the method of any of EXAMPLES 55-60, wherein the digital pulse density modulation for each pixel includes adding accumulated pixel data signals and providing a carry signal. In addition, the method includes for each pixel driving current to increase the brightness in the one or more light-emitting diodes corresponding to that pixel in response to the carry signal.

Example 62

In some examples, an apparatus including means to perform a method as claimed in any preceding EXAMPLE.

Although example embodiments of the disclosed subject matter is described with reference to circuit and block diagrams in the figures, persons of ordinary skill in the art will readily appreciate that many other ways of implementing the disclosed subject matter may alternatively be used. For example, the order of execution of the blocks in flow diagrams may be changed, and/or some of the blocks in block/flow diagrams described may be changed, eliminated, or combined. Additionally, some of the circuit elements may be changed, eliminated, or combined.

In the preceding description, various aspects of the disclosed subject matter have been described. For purposes of explanation, specific numbers, systems and configurations were set forth in order to provide a thorough understanding of the subject matter. However, it is apparent to one skilled in the art having the benefit of this disclosure that the subject matter may be practiced without the specific details. In other instances, well-known features, components, or modules were omitted, simplified, combined, or split in order not to obscure the disclosed subject matter.

Various embodiments of the disclosed subject matter may be implemented in hardware, firmware, software, or combination thereof, and may be described by reference to or in conjunction with program code, such as instructions, functions, procedures, data structures, logic, application programs, design representations or formats for simulation, emulation, and fabrication of a design, which when accessed by a machine results in the machine performing tasks, defining abstract data types or low-level hardware contexts, or producing a result.

Program code may represent hardware using a hardware description language or another functional description language which essentially provides a model of how designed hardware is expected to perform. Program code may be assembly or machine language or hardware-definition languages, or data that may be compiled and/or interpreted. Furthermore, it is common in the art to speak of software, in one form or another as taking an action or causing a result. Such expressions are merely a shorthand way of stating execution of program code by a processing system which causes a processor to perform an action or produce a result.

Program code may be stored in, for example, volatile and/or non-volatile memory, such as storage devices and/or an associated machine readable or machine accessible medium including solid-state memory, hard-drives, floppy-disks, optical storage, tapes, flash memory, memory sticks, digital video disks, digital versatile discs (DVDs), etc., as well as more exotic mediums such as machine-accessible biological state preserving storage. A machine readable medium may include any tangible mechanism for storing, transmitting, or receiving information in a form readable by a machine, such as antennas, optical fibers, communication interfaces, etc. Program code may be transmitted in the form of packets, serial data, parallel data, etc., and may be used in a compressed or encrypted format.

Program code may be implemented in programs executing on programmable machines such as mobile or stationary computers, personal digital assistants, set top boxes, cellular telephones and pagers, and other electronic devices, each including a processor, volatile and/or non-volatile memory readable by the processor, at least one input device and/or one or more output devices. Program code may be applied to the data entered using the input device to perform the described embodiments and to generate output information. The output information may be applied to one or more output devices. One of ordinary skill in the art may appreciate that embodiments of the disclosed subject matter can be practiced with various computer system configurations, including multiprocessor or multiple-core processor systems, minicomputers, mainframe computers, as well as pervasive or miniature computers or processors that may be embedded into virtually any device. Embodiments of the disclosed subject matter can also be practiced in distributed computing environments where tasks may be performed by remote processing devices that are linked through a communications network.

Although operations may be described as a sequential process, some of the operations may in fact be performed in parallel, concurrently, and/or in a distributed environment, and with program code stored locally and/or remotely for access by single or multi-processor machines. In addition, in some embodiments the order of operations may be rearranged without departing from the spirit of the disclosed subject matter. Program code may be used by or in conjunction with embedded controllers.

While the disclosed subject matter has been described with reference to illustrative embodiments, this description is not intended to be construed in a limiting sense. Various modifications of the illustrative embodiments, as well as other embodiments of the subject matter, which are apparent to persons skilled in the art to which the disclosed subject matter pertains are deemed to lie within the scope of the disclosed subject matter. For example, in each illustrated embodiment and each described embodiment, it is to be understood that the diagrams of the figures and the description herein is not intended to indicate that the illustrated or described devices include all of the components shown in a particular figure or described in reference to a particular figure. In addition, each element may be implemented with logic, wherein the logic, as referred to herein, can include any suitable hardware (e.g., a processor, among others), software (e.g., an application, among others), firmware, or any suitable combination of hardware, software, and firmware, for example.

What is claimed is:

1. A system for driving current, comprising:

a mixed signal pulse density modulation display driver, including:

a digital pulse density modulation circuit to provide an output in response to pixel data corresponding to one or more pixels in a display, wherein the digital pulse density modulation circuit is a sigma delta modulator, and wherein the digital pulse density modulation circuit includes an adder to add accumulated pixel data signals and to provide a carry signal as the output of the digital pulse density modulation circuit; and an analog circuit to drive current to increase a brightness in one or more light-emitting diodes in the display in response to the carry signal output from the digital pulse density modulation circuit.

2. The system of claim 1, wherein the sigma delta modulator is a second order sigma delta modulator.

3. The system of claim 1, comprising the analog circuit to drive a fixed offset current to increase the brightness in the one or more light-emitting diodes, and to drive additional current through the one or more light-emitting diodes in addition to the fixed offset current in response to the output from the digital pulse density modulation circuit.

4. The system of claim 3, wherein the fixed offset current is provided in response to a bias voltage provided in response to the pixel data.

5. The system of claim 1, the analog circuit to drive a fixed offset current to increase an average brightness in the one or more light-emitting diodes.

6. The system of claim 5, the analog circuit to drive the fixed offset current to increase the average brightness in the one or more light-emitting diodes in response to the output of the digital pulse density modulation circuit.

7. The system of claim 1, comprising a plurality of pixel driving circuits to each drive current through one or more corresponding light-emitting diodes in the display, at least one of the pixel driving circuits including the digital pulse density modulation circuit and the analog circuit.

8. The system of claim 7, each of the plurality of pixel driving circuits including:

a digital pulse density modulation circuit to provide an output in response to pixel data; and an analog circuit to drive current to increase a brightness in the corresponding one or more light-emitting diodes in response to the output from the digital pulse density modulation circuit.

9. The system of claim 7, comprising the analog circuit to drive a fixed offset current to increase the brightness in the corresponding one or more light-emitting diodes, and to drive additional current through the corresponding one or more light-emitting diodes in addition to the fixed offset current in response to the output from the digital pulse density modulation circuit.

10. The system of claim 9, wherein the fixed offset current is provided in response to a bias voltage provided in response to the pixel data.

11. The system of claim 1, wherein the analog circuit is to drive fixed offset current.

12. The system of claim 1, wherein the analog circuit is to drive current to increase an average brightness of the one or more light-emitting diodes.

13. A method for driving current, comprising:

performing mixed signal pulse density modulation current driving for a display, including:

performing digital pulse density modulation in response to pixel data corresponding to one or more pixels in the display, wherein the digital pulse density modulation is sigma delta modulation, and wherein the digital pulse density modulation includes adding accumulated pixel data signals and providing a carry signal; and driving current in an analog manner to increase a brightness in one or more light-emitting diodes in the display in response to the carry signal of the digital pulse density modulation.

14. The method of claim 13, wherein the sigma delta modulation is second order sigma delta modulation.

15. The method of claim 13, comprising:

driving a fixed offset current to increase the brightness in the one or more light-emitting diodes; and driving additional current through the one or more light-emitting diodes in addition to the fixed offset current in response to the digital pulse density modulation.

16. The method of claim 15, comprising providing the fixed offset current in response to a bias voltage that is responsive to the pixel data.

17. The method of claim 13, the driving comprising driving fixed offset current to increase the brightness in the one or more light-emitting diodes.

18. The method of claim 13, the driving comprising driving current to increase an average brightness in the one or more light-emitting diodes.

* * * * *